US006676273B2

(12) United States Patent
Kwak

(10) Patent No.: US 6,676,273 B2
(45) Date of Patent: Jan. 13, 2004

(54) FLASHLIGHT

(76) Inventor: Jeong-Kook Kwak, 203-702 Hyundai Hometown 2-Danji, 19-4 Kaibong-dong 480, Kuro-gu, Seoul 152-090 (KR)

( * ) Notice: Subject to any disclaimer, the term of this patent is extended or adjusted under 35 U.S.C. 154(b) by 0 days.

(21) Appl. No.: 10/101,315

(22) Filed: Mar. 20, 2002

(65) Prior Publication Data

US 2002/0159254 A1 Oct. 31, 2002

(30) Foreign Application Priority Data

Apr. 2, 2001 (KR) ..... 2001-0009215

(51) Int. Cl.[7] ..... F21L 7/00
(52) U.S. Cl. ..... 362/205; 362/202; 362/208
(58) Field of Search ..... 362/184, 202, 362/205, 208, 295, 183

(56) References Cited

U.S. PATENT DOCUMENTS 4,605,993 A * 8/1986 Zelina, Jr. ..... 362/183
4,835,665 A * 5/1989 Kao ..... 362/184
5,143,442 A * 9/1992 Ishikawa et al. ..... 362/253
5,578,992 A * 11/1996 Harding ..... 340/574
5,806,961 A * 9/1998 Dalton et al. ..... 362/183
6,471,367 B2 * 10/2002 Garofalo ..... 362/190

* cited by examiner

*Primary Examiner*—Thomas M. Sember
(74) *Attorney, Agent, or Firm*—Dennison, Schultz & Dougherty

(57) ABSTRACT

A flashlight includes a conductive case constructed and arranged for incorporating a power supply including batteries, a head part coupled with the case via a bulb, and a switch assembly mounted in the case for turning the power supply on and off. The switch assembly includes a circuit board, a switch button at an edge of the circuit board, a display lamp for indicating amount of consumption amount of the batteries, a negative terminal and a spring fixed at one end thereof to the circuit board by soldering for connection to a negative battery terminal, and which contacts at an opposite end thereof a bottom end of the bulb. The switch is fixed to the case with a screw passing through a hole in the case such that the screw contacts the negative terminal, the negative terminal protruding from the switch assembly in a longitudinal direction at an upper end of the switch assembly, so that a negative current is transmitted to the spring via the conductive case, the screw and the negative terminal.

4 Claims, 3 Drawing Sheets

FLASHLIGHT

BACKGROUND OF THE INVENTION (a) Field of the Invention

The present invention relates to a flashlight, in which respective parts are directly connected to a circuit printed board of a switch by improving the structure of a switch for improving the assembling work of the switch, the switch is fixed in a case of the flashlight via a screw for directly contacting an upper end of the switch with a negative terminal by the screw, and a bulb is applied with a fluorescent substance for a user to easily find out the flashlight.

(b) Description of the Related Art

In general, a flashlight is utilized in case of power failure, in camping or fishing places and in the nighttime.

Such a flashlight incorporates batteries to be carried and utilized conveniently and lights a bulb by alternatively turning on or off power supply from the batteries with a switch.

It is, however, impossible in the conventional flashlight to figure out a consumption amount of the batteries so that a user has to prepare spare batteries in advance. In order to resolve the above inconvenience, Korean Patent Application No. 1999-57746 discloses a flashlight indicating the battery consumption, in which a display lamp is mounted at an upper end part of a main body to check the power consumption of the batteries.

Still, this flashlight has disadvantages that the assembling is complicated since positive and negative terminals, a switch, the display lamp, a spring and the like are connected via electric wires and welded on a printed circuit board, thereby decreasing the productivity and increasing the manufacturing cost.

Furthermore, in case of a sudden power failure in the nighttime, if a user does not know where the flashlight is placed, it is very difficult to find out the flashlight, thereby causing inconvenience.

SUMMARY OF THE INVENTION

Therefore, the present invention is derived to resolve the above problems of the prior art and has an object to provide a flashlight in which respective parts are connected to a printed circuit board of a switch directly for improving the assembling.

It is another object of the present invention to provide a flashlight in which a bulb is applied with a luminous substance for emitting light in the nighttime and in the dark, thereby being easily found out.

It is a further object of the present invention to provide a flashlight in which a switch is fixed in a case with a screw for the flow of a negative current from a negative terminal of the switch, the screw, the case, and a spring of a cover in series.

In order to achieve the above and other advantages and in accordance with the purpose of the present invention, as embodied and broadly described, in a flashlight including a case for incorporating batteries, a head part coupled with the case via a bulb, and a switch mounted in the case for turning on or off the power supply of the batteries, an improvement includes a switch assembly having a switch button at an edge of a circuit board of the switch, and a display lamp for indicating a consumption amount of the batteries, wherein the switch is composed of a spring directly welded to an inner surface of the case for contacting a negative terminal and a bottom end of the bulb.

According to the present invention, the switch assembly has a positive terminal, which is withdrawn outside a main body.

The spring is formed with a folded part at an end, which penetrates the circuit board.

The bulb is applied with a fluorescent substance on a glass portion.

The switch is fixed to the case by inserting a screw via a hole of the case in such a manner that the screw contacts the negative terminal which is protruded long in a traverse direction at an upper end of the switch so that a negative current is transmitted to the spring in a lid via the screw and the case which is conductive.

According to the present invention, the printed circuit board is mounted to the switch main body which is mounted in the case and fixed with the switch assembly, the display lamp for indicating a battery consumption amount, the negative terminal, the spring and the like at edge parts by welding, so that the assembling of the parts becomes simplified. Further, due to the applying of the fluorescent substance on the bulb, the flashlight may be easily found out in the dark even when the power of the flashlight is turned off. Furthermore, the switch is easily fixed in the case by the screw and the screw becomes contact the negative terminal at the upper end of the switch directly.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

The present invention will be explained in more detail with reference to preferred embodiments in junctions with the attached drawings.

Figure 1:
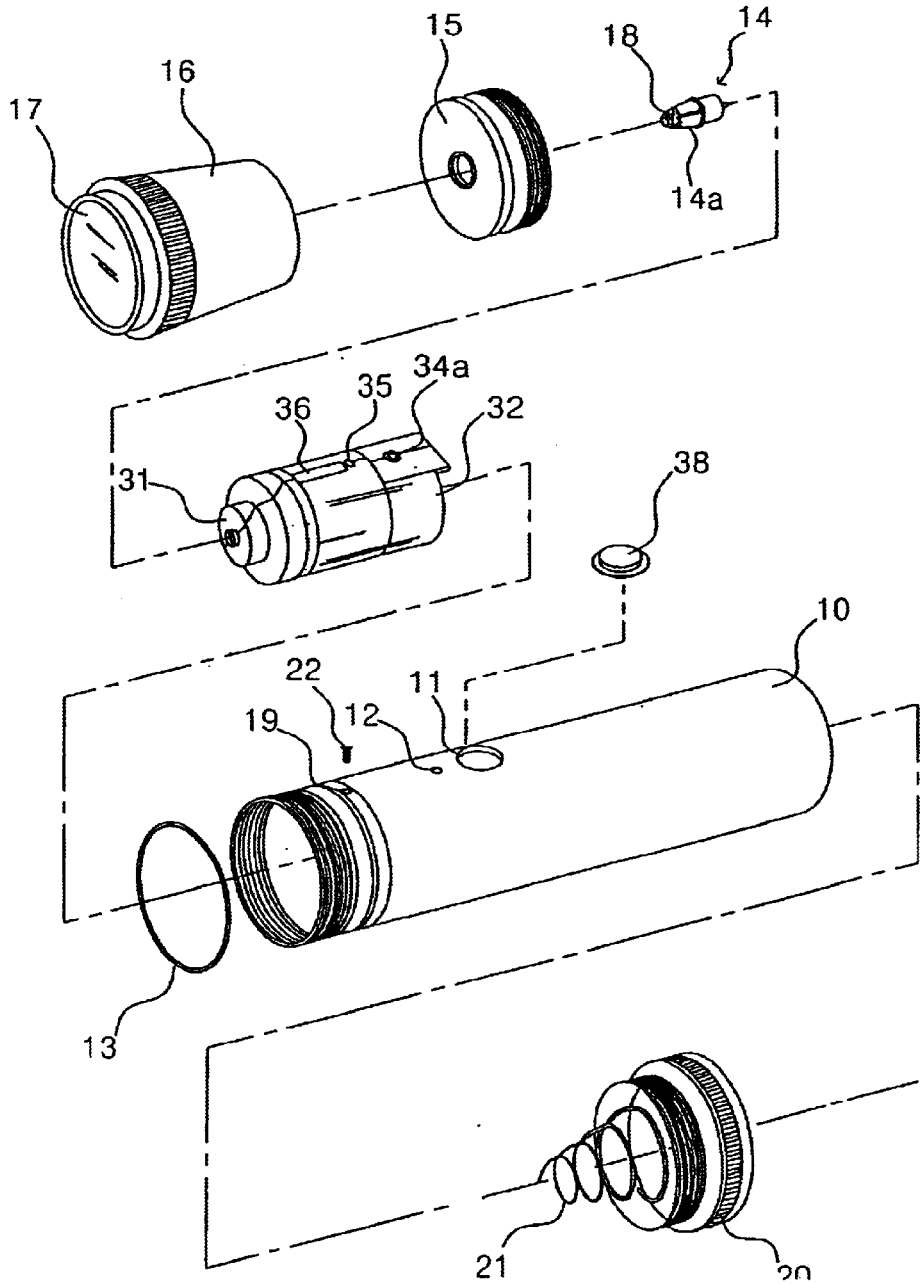
FIG. 1 is a perspective view showing a whole flashlight according to the present invention, which is disassembled.

FIG. 1 is a disassembled perspective view of a structure of a switch according to the present invention. In FIG. 1, a cylindrical metal case 10 is formed with a plurality of holes 11, 12 and 19 and coupled with a fixing element 15 and a head 16 via a rubber ring 13 at an upper end, wherein a bulb 14 is inserted and fixed in the fixing element.

The fixing element is coupled with an inner surface of the case 10. The head 16 is coupled with an outer surface of the case and a floodlighting plate 17 is inserted and fixed in a front surface portion of the head.

The case 10 is further coupled with a lid 20 at a rear surface via batteries, which are not shown, wherein a spring 21 is formed in the lid 20 for compressing the batteries.

A switch 30 is inserted in the case 10 and a screw 22 is inserted into the case via the hole 19, so that a conductive negative terminal 36, which is protruded long in a traverse direction, is fixed at an upper end part of the switch 30 in contact. A switch cover 38 and display lamp 35, as shown in FIG. 2, are respectively inserted into 20 the holes 11 and 12 of the case 10.

The bulb 14 is applied with a fluorescent substance 18 on a glass portion 14*a*, wherein the fluorescent substance 18 is preferably applied on the surface of the glass portion 14*a* of the bulb 14, that is, on a front surface locally.

Figure 2:
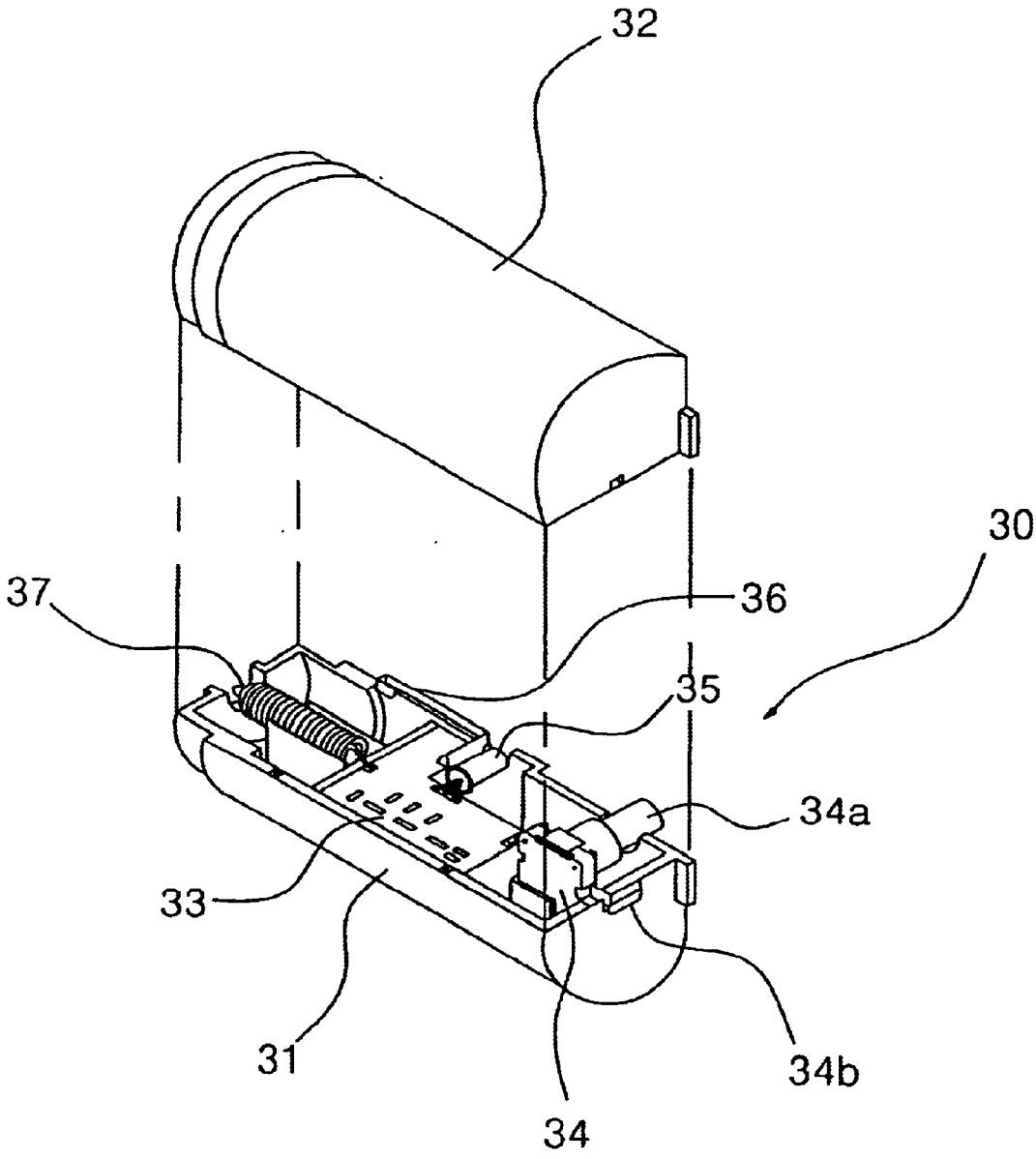
FIG. 2 is a perspective view showing a structure of a switch of the flashlight according to the present invention, which is disassembled.

FIG. 2 is a view showing the switch 30 of the present invention. In FIG. 2, the switch 30 includes a main body 31 in the shape of semi-cylinder, and a cover 32 which is coupled with the main body 31 by an element such as a protrusion in such a manner that the main body and the cover face to each other.

Further, the switch main body 31 is mounted with a printed circuit board 33 approximately in the center. The printed circuit board 33 is connected with a switch assembly 34 having a button 34*a* at a side, the display lamp 35 for indicating the battery consumption amount, the negative terminal 36 contacting an inner surface of the case 10 and a spring 37 electrically connecting a lower end of the bulb 14 respectively and directly and simultaneously fixed by soldering.

The switch assembly 34 is formed with a positive terminal 34*b* at a side, the positive terminal 34*b* being protruded outside the main body 31 so as to be connected to a positive polarity portion of one of the batteries.

The switch button 34*a* is provided with a switch cover 38, which is positioned in the hole 11 for waterproofing.

Figure 3:
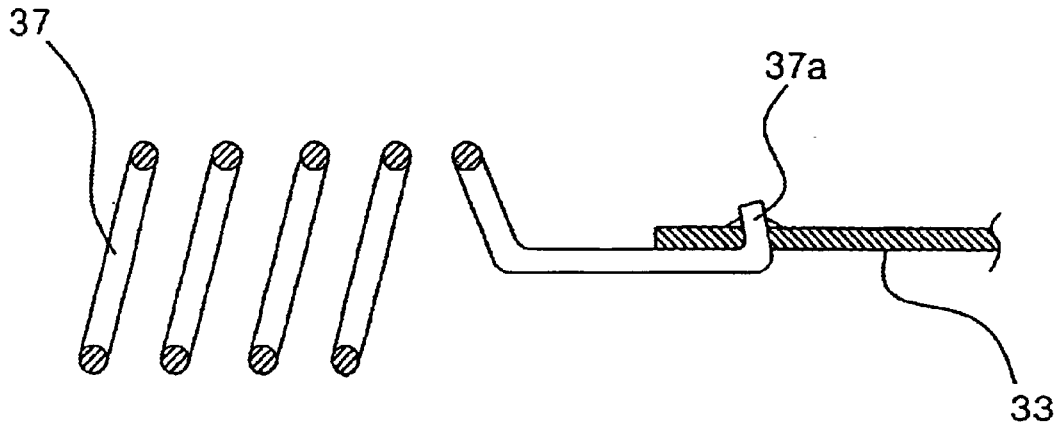
FIG. 3 is a cross-sectional view of a spring fixing part according to the present invention.

FIG. 3 shows a state that an end of the spring 37 is fixed to the printed circuit board 33. In FIG. 3, the end of the spring 37 is formed with a folded part 37*a* for penetrating the printed circuit board 33 to be welded.

Now, the operation of the present invention will be described in more detail.

In the switch structure of the flashlight according to the present invention, the switch assembly 34, the display lamp 35 for indicating a battery consumption amount, the negative terminal 36 and the spring 37 contacting the lower end of the bulb 14 are respectively connected to edge portions of the printed circuit board 33 which is mounted in the switch main body 31.

Further, the spring 37 is, as shown in FIG. 3, fixed to the printed circuit board 33 by soldering since the end of the spring 37 is formed with the folded part 37*a*.

A user may check a consumption amount of the batteries according to the brightness of the display lamp 35, which indicates the battery consumption amount.

On the other hand, according to the present invention, the screw 22 is inserted and fixed to the case 10 via the hole 19 for fixing the switch 30, which is formed at the upper end of the case 10, for fixing the switch 30 while the switch 30 is inserted in the case 10, wherein the screw 22 directly contacts the protruded negative terminal 36 which is elongated in the traverse direction at the upper end portion of the switch 30.

Therefore, as the screw 22 comes into contact with the negative terminal 36, the negative current flows to the spring 37 in the lid 20 via the negative terminal 36, the screw 22, and the conductive metal case 10 in series, so that the negative current of the batteries is transmitted to the bulb 14 and the positive terminal 34*b* via the negative terminal 36 for lighting the bulb 14 if the user presses the button 34*a*.

At this time, the screw 22 is not shown outside for providing a good appearance since the rubber ring 13 is fitted on the screw 22 while the screw 22 is inserted into the hole 19.

Further, according to the present invention, the glass portion 14*a* of the bulb 14 is applied with the fluorescent substance 18, so that the bulb emits light from the fluorescent substance in the nighttime or in the dark place even when the power of the flashlight is off. Accordingly, the flashlight may be easily found out. At this time, the fluorescent substance 18 is preferably applied on the glass portion 14*a* of the bulb 14, that is, the front surface part locally.

As described hereinabove, according to the present invention, the flashlight is mounted with a printed circuit board in the switch main body which is mounted in the case, and the printed circuit board is mounted with the switch assembly, the display lamp for indicating the battery consumption amount, the negative terminal, the spring and the like directly by welding, so that the assembling of such parts becomes simplified, reducing the assembling procedure, and the productivity and the assembling become improved, reducing the manufacturing cost.

Further, according to the present invention, the flashlight may be easily found out in the nighttime or in the dark place even when the power of the flashlight is off since the fluorescent substance is applied on the bulb.

Furthermore, according to the present invention, the negative current may be transmitted to the spring of the lid via the negative terminal, the screw and the case since the switch is fixed in the case by the screw.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A flashlight comprising:

a conductive case constructed and arranged for incorporating a power supply including batteries, a head part coupled with the case via a bulb, and a switch assembly mounted in the case for turning the power supply on and off, the switch assembly including a circuit board, a switch button at an edge of the circuit board, a display lamp for indicating amount of consumption of the batteries, a negative terminal and a spring fixed at one end thereof to the circuit board by soldering for connection to the negative terminal, and which contacts at an opposite end thereof a bottom end of the bulb, wherein the switch is fixed to the case with a screw passing through a hole in the case such that the screw contacts the negative terminal, the negative terminal protruding from the switch assembly in a longitudinal direction at an upper end of the switch assembly, so that a negative current is transmitted to the spring from the power supply via the conductive case, the screw and the negative terminal.

2. A flashlight according to claim 1, wherein the switch assembly further includes a positive terminal which protrudes from a main body portion of the switch assembly.

3. A flashlight according to claim 1, wherein the spring is formed with a folded part at an end thereof, the folded part penetrating the circuit board.

4. A flashlight according to claim 1, wherein the bulb comprises a fluorescent substance applied to a glass portion thereof.

* * * * *